US006761437B2

(12) United States Patent
Delametter et al.

(10) Patent No.: US 6,761,437 B2
(45) **Date of Patent: *Jul. 13, 2004**

(54) APPARATUS AND METHOD OF ENHANCING FLUID DEFLECTION IN A CONTINUOUS INK JET PRINTHEAD

(75) Inventors: Christopher N. Delametter, Rochester, NY (US); James M. Chwalek, Pittsford, NY (US); David P. Trauernicht, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/273,916

(22) Filed: Oct. 18, 2002

(65) Prior Publication Data

US 2003/0043223 A1 Mar. 6, 2003

Related U.S. Application Data

(63) Continuation-in-part of application No. 09/470,638, filed on Dec. 22, 1999, now Pat. No. 6,497,510.

(51) Int. Cl.[7] ..... B41J 2/02
(52) U.S. Cl. ..... 347/73
(58) Field of Search ..... 347/73, 74, 75, 347/77, 82, 89, 94, 54, 85

(56) References Cited

U.S. PATENT DOCUMENTS

| | | | | |
|---|---|---|---|---|
| 1,941,001 A | | 12/1933 | Hansell | |
| 3,373,437 A | | 3/1968 | Sweet et al. | |
| 3,416,153 A | | 12/1968 | Hertz et al. | |
| 3,878,519 A | | 4/1975 | Eaton | |
| 3,893,623 A | | 7/1975 | Toupin | |
| 4,346,387 A | | 8/1982 | Hertz | |
| 5,734,395 A | * | 3/1998 | Kamisuki et al. | 347/54 |
| 5,746,373 A | * | 5/1998 | Sanada | 239/102.2 |
| 5,841,452 A | | 11/1998 | Silverbrook | |
| 5,966,154 A | * | 10/1999 | DeBoer | 347/82 |
| 6,382,782 B1 | | 5/2002 | Anagnostopoulos et al. | |
| 6,497,510 B1 | * | 12/2002 | Delametter et al. | 347/74 |

FOREIGN PATENT DOCUMENTS

| | | |
|---|---|---|
| EP | 0 308 272 A1# | 3/1989 |
| EP | 0 474 472 A1# | 3/1992 |
| EP | 0 805 036 A2# | 11/1997 |
| EP | 0 911 167 A2# | 4/1999 |
| JP | 6-183029-A# | 7/1994 |

* cited by examiner

*Primary Examiner*—Anh T. N. Vo
(74) *Attorney, Agent, or Firm*—William R. Zimmerli

(57) ABSTRACT

A continuous ink jet printhead and method are provided. The printhead includes an ink delivery channel. A plurality of nozzle bores are in fluid communication with the ink delivery channel. An individual obstruction is associated with each nozzle bore. Each individual obstruction is positioned in the ink delivery channel such that each obstruction creates a lateral flow pattern in ink continuously flowing through each of the plurality of nozzle bores as measured from a plane perpendicular to the plurality of nozzle bores.

42 Claims, 8 Drawing Sheets

APPARATUS AND METHOD OF ENHANCING FLUID DEFLECTION IN A CONTINUOUS INK JET PRINTHEAD

CROSS REFERENCE TO RELATED APPLICATIONS

This application is a continuation-in-part of U.S. patent application Ser. No. 09/470,638 filed Dec. 22, 1999 now U.S. Pat. No. 6,497,510 and assigned to the Eastman Kodak Company.

FIELD OF THE INVENTION

The present invention relates generally to the field of digitally controlled ink jet printing systems. It particularly relates to improving those systems that asymmetrically heat a continuous ink stream, in order to deflect the stream's flow between a non-print mode and a print mode.

BACKGROUND OF THE PRIOR ART

Ink jet printing is only one of many digitally controlled printing systems. Other digital printing systems include laser electrophotographic printers, LED electrophotographic printers, dot matrix impact printers, thermal paper printers, film recorders, thermal wax printers, and dye diffusion thermal transfer printers. Ink jet printers have become distinguished from the other digital printing systems because of the ink jet's non-impact nature, its low noise, its use of plain paper, and its avoidance of toner transfers and filing.

The ink jet printers can be categorized as either drop-on-demand or continuous systems. However, it is the continuous ink jet system which has gained increasingly more recognition over the years. Major developments in continuous ink jet printing are as follows:

Continuous ink jet printing itself dates back to at least 1929. See U.S. Pat. No. 1,941,001 which issued to Hansell that year.

U.S. Pat. No. 3,373,437, which issued to Sweet et al. in March 1968, discloses an array of continuous ink jet nozzles wherein ink drops to be printed are selectively charged and deflected towards the recording medium. This technique is known as binary deflection continuous ink jet printing, and is used by several manufacturers, including Elmjet and Scitex.

U.S. Pat. No. 3,416,153, issued to Hertz et al. in December 1968. It discloses a method of achieving variable optical density of printed spots, in continuous ink jet printing. Therein the electrostatic dispersion of a charged drop stream serves to modulate the number of droplets which pass through a small aperture. This technique is used in ink jet printers manufactured by Iris.

U.S. Pat. No. 4,346,387, also issued to Hertz, but it issued in 1982. It discloses a method and apparatus for controlling the electrostatic charge on droplets. The droplets are formed by the breaking up of a pressurized liquid stream, at a drop formation point located within an electrostatic charging tunnel, having an electrical field. Drop formation is effected at a point in the electric field, corresponding to whatever predetermined charge is desired. In addition to charging tunnels, deflection plates are used to actually deflect the drops.

Until recently, conventional continuous ink jet techniques all utilized, in one form or another, electrostatic charging tunnels that were placed close to the point where the drops are formed in a stream. In the tunnels, individual drops may be charged selectively. The selected drops are charged and deflected downstream by the presence of deflector plates that have a large potential difference between them. A gutter (sometimes referred to as a "catcher") is normally used to intercept the charged drops and establish a non-print mode, while the uncharged drops are free to strike the recording medium in a print mode as the ink stream is thereby deflected, between the "non-print" mode and the "print" mode.

Recently, a novel continuous ink jet printer system has been developed which renders the above-described electrostatic charging tunnels unnecessary. Additionally, it serves to better couple the functions of (1) droplet formation and (2) droplet deflection. That system is disclosed in our copending U.S. Pat. No. 6,079,821 entitled "CONTINUOUS INK JET PRINTER WITH ASYMMETRIC HEATING DROP DEFLECTION". Therein disclosed is an apparatus for controlling ink in a continuous ink jet printer. The apparatus comprises an ink delivery channel, a source of pressurized ink in communication with the ink delivery channel, and a nozzle having a bore which opens into the ink delivery channel, from which a continuous stream of ink flows. A droplet generator inside the nozzle causes the ink stream to break up into a plurality of droplets at a position spaced from the nozzle. The droplets are deflected by heat from a heater (in the nozzle bore) which heater has a selectively actuated section, i.e. a section associated with only a portion of the nozzle bore. Selective actuation of a particular heater section, at a particular portion of the nozzle bore produces what has been termed an asymmetrical application of heat to the stream. Alternating the sections can, in turn, alternate the direction in which this asymmetrical heat is applied and serves to thereby deflect the ink droplets, inter alia, between a "print" direction (onto a recording medium) and a "non-print" direction (back into a "catcher").

Asymmetrically applied heat results in steam deflection, the magnitude of which depends upon several factors, e.g. the geometric and thermal properties of the nozzles, the quantity of applied heat, the pressure applied to, and the physical, chemical and thermal properties of the ink. Although solvent-based (particularly alcohol-based) inks have quite good deflection patterns, and achieve high image quality in asymmetrically heated continuous ink jet printers, water-based inks until now, have not. Water-based inks require a greater degree of deflection for comparable image quality than the asymmetric treatment, jet velocity, spacing, and alignment tolerances have in the past allowed. Accordingly, a means for enhancing the degree of deflection for such continuous ink jet systems, within system tolerances would represent a surprising but significant advancement in the art and satisfy an important need in the industry for water-based, and thus more environmentally friendly inks.

SUMMARY OF THE INVENTION

According to a feature of the present invention, a continuous ink jet printhead includes an ink delivery channel. A plurality of nozzle bores are in fluid communication with the ink delivery channel. An individual obstruction is associated with each nozzle bore. Each individual obstruction is positioned in the ink delivery channel such that each obstruction creates a lateral flow pattern in ink continuously flowing through each of the plurality of nozzle bores as measured from a plane perpendicular to the plurality of nozzle bores.

According to another feature of the present invention, a continuous ink jet printhead includes a body, portions of the body defining an ink delivery channel, other portions of the body defining a nozzle bore, the nozzle bore being in fluid communication with the ink delivery channel. An obstruction is positioned in the ink delivery channel such that the obstruction creates a lateral flow pattern in ink continuously flowing through the nozzle bore as measured from a plane perpendicular to the nozzle bore.

According to another feature of the present invention, a method of enhancing ink deflection in a continuous ink jet printhead includes providing a continuous flow of ink through a nozzle bore; creating a lateral flow pattern in the ink; and causing the ink to deflect as the ink flows through the nozzle bore.

DETAILED DESCRIPTION OF THE INVENTION

The present description will be directed, in particular, to elements forming part of, or cooperating directly with, apparatus or processes of the present invention. It is to be understood that elements not specifically shown or described may take various forms well known to those skilled in the art.

Figure 1:
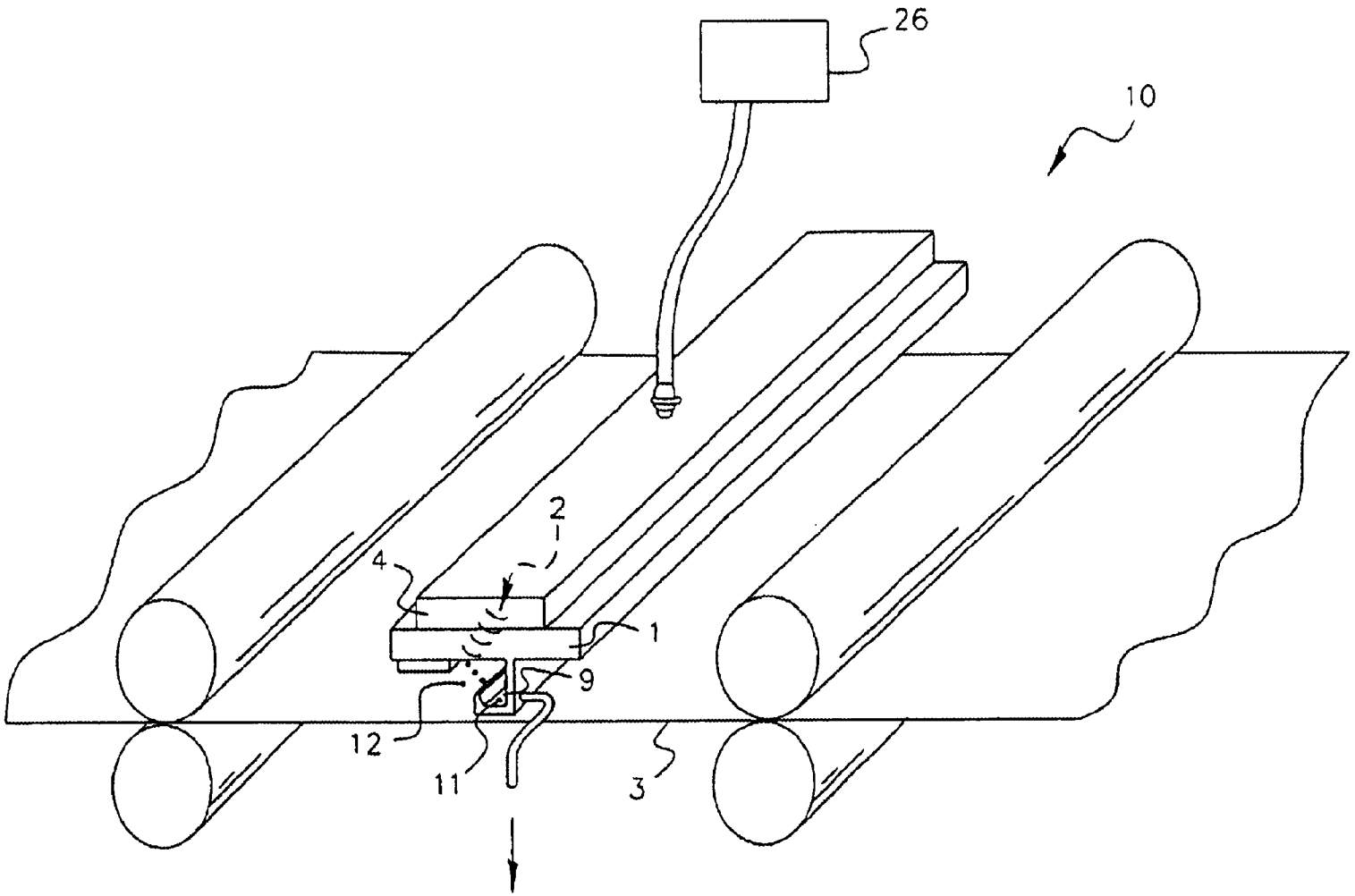
FIG. 1 shows a schematic diagram of an exemplary continuous ink jet print head and nozzle array as a print medium (e.g. paper) rolls under the ink jet print head.

Referring to FIG. 1, a continuous ink jet printer system is generally shown at 10. The print head 1, from which extends an array of nozzle heaters 2, houses heater control circuits (not shown) which process signals to an ink pressure regulator (not shown).

Heater control circuits read data from the image memory, and send time-sequenced electrical pulses to the array of nozzle heaters 2. These pulses are applied at an appropriate time, and to the appropriate nozzle, so that drops formed from a continuous ink jet stream will form spots on a recording medium 3, in the appropriate position designated by the data sent from the image memory. Pressurized ink travels from an ink reservoir 26 to an ink delivery channel 4 and through nozzle array 2 onto either the recording medium 3 or the gutter 9.

Figure 2:
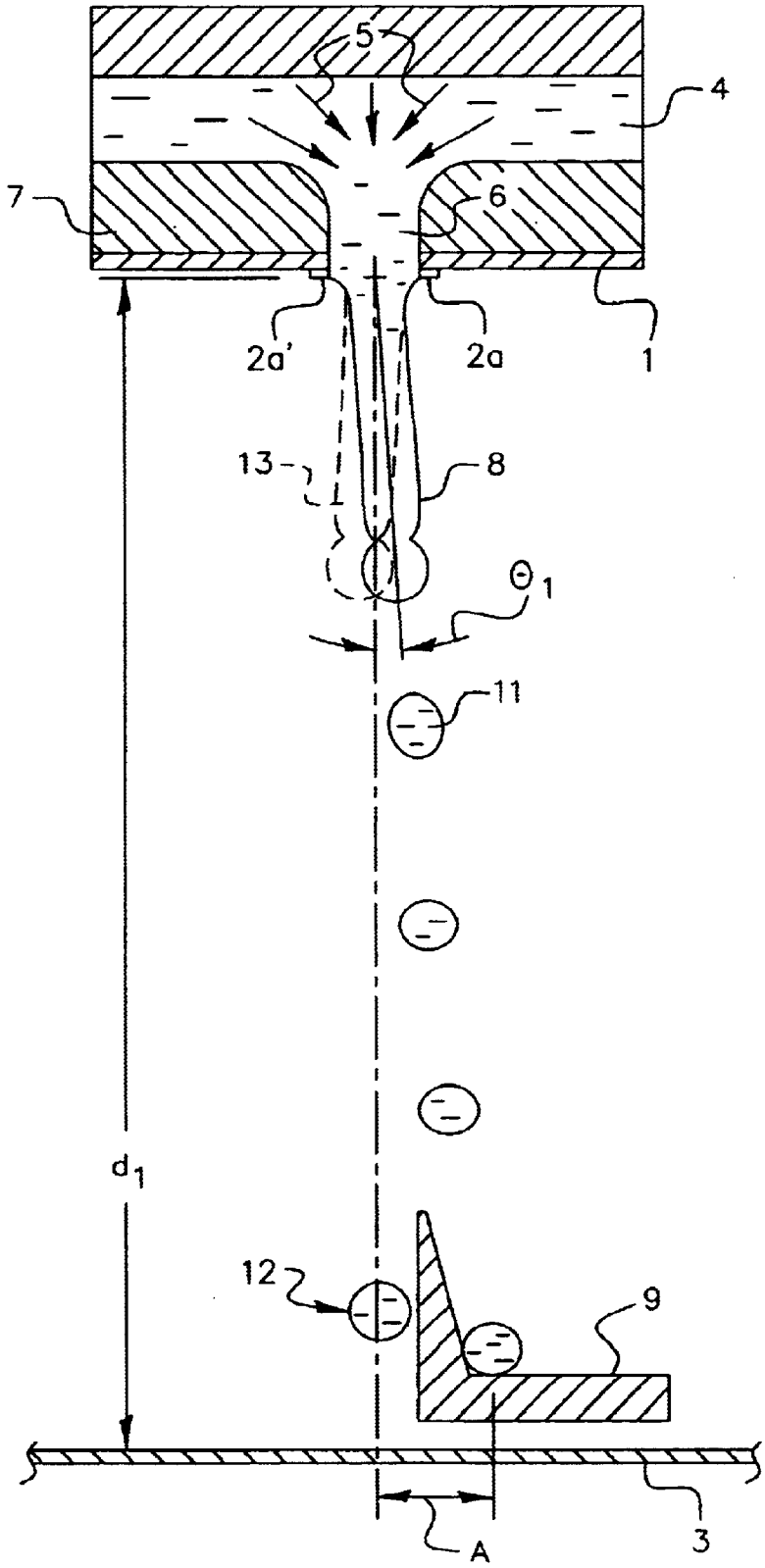
FIG. 2 (PRIOR ART)
FIG. 2 is a cross-sectional view of one nozzle from a prior art nozzle array showing $d_1$ (distance to print medium) and $\theta_1$ (angle of deflection)

Referring now to FIG. 2, an enlarged cross-sectional view of a single nozzle heater 2*a*/2*a*' from among the nozzle array 2 shown in FIG. 1, is illustrated, as it is in the prior art. Note that ink delivery channel 4 shows arrows 5 that depict a substantially vertical flow pattern of ink headed into nozzle bore 6. There is a relatively thick wall 7 which serves, inter alia, to insulate the ink in the channel 4 from heat generated in the nozzle heater 2*a*/2*a*'. Thick wall 7 may also be referred to as the "orifice membrane." An ink stream 8 forms as a meniscus of ink initially leaving the nozzle bore 6. At a distance below the nozzle bore 6 ink stream 8 breaks into a plurality of drops 11.

Figure 3:
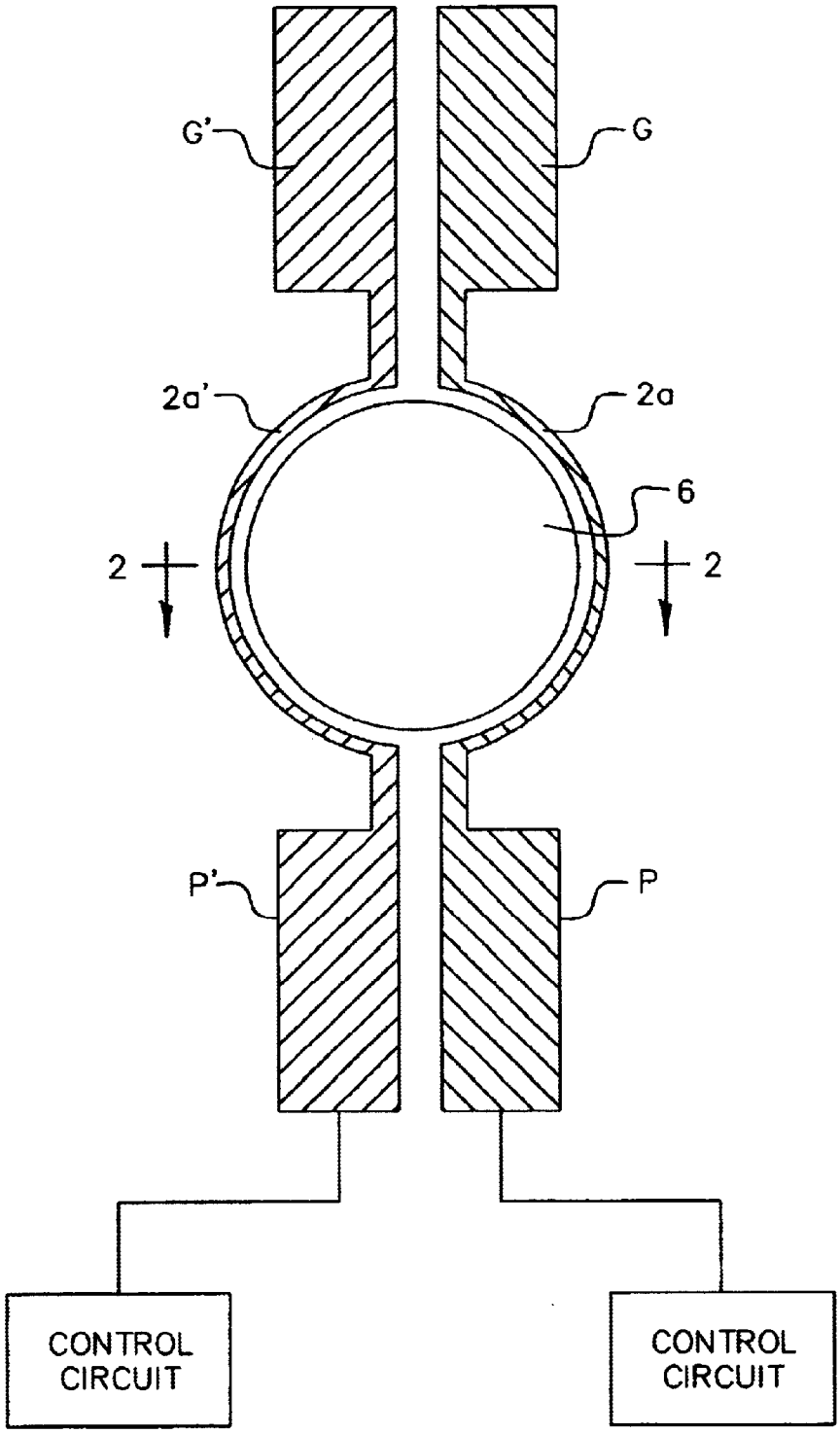
FIG. 3 shows a top view directly into a nozzle with an asymmetric heater surrounding the nozzle.

Referring to FIG. 3, and back to FIG. 2, an expanded bottom view of heater 2*a*/2*a*' showing the line 2—2, along which line the FIG. 2 cross-sectional illustration is viewed. Heater 2*a*/2*a*' can be seen to have two sections (sections 2*a* and 2*a*'). Each section covers approximately one half of the nozzle bore opening 6. Alternatively, heater sections can vary in number and sectional design. One section provides a common connection G, and isolated connection P. The other has G' and P' respectively. Asymmetrical application of heat merely means applying electrical current to one or the other section of the heater independently. By so doing, the heat will deflect the ink stream 8, and deflect the drops 11, away from the particular source of the heat. For a given amount of heat, the ink drops 11 are deflected at an angle $\theta_1$ (in FIG. 2) and will travel a vertical distance $d_1$ onto recording media 3 from the print head. There also is a distance "A", which distance defines the space between where the deflection angle $\theta_1$ would place the deflected drops 11 on the recording media (or a catcher) and where the drops 12 would have landed without deflection. The stream deflects in a direction anyway from the application of heat. The ink gutter 9 is configured to catch deflected ink droplets 11 while allowing undeflected drop 12 to reach a recording medium. An alternative embodiment of the present invention could reorient ink gutter ("catcher") 9 to be placed so as to catch undeflected drops 12 while allowing deflected drops 11 to reach the recording medium.

The ink in the delivery channel emanates from a pressurized reservoir 26, leaving the ink in the channel under pressure. In the past the ink pressure suitable for optimal operation would depend upon a number of factors, particularly geometry and thermal properties of the nozzles and thermal properties of the ink. A constant pressure can be achieved by employing an ink pressure regulator (not shown).

Figure 4:
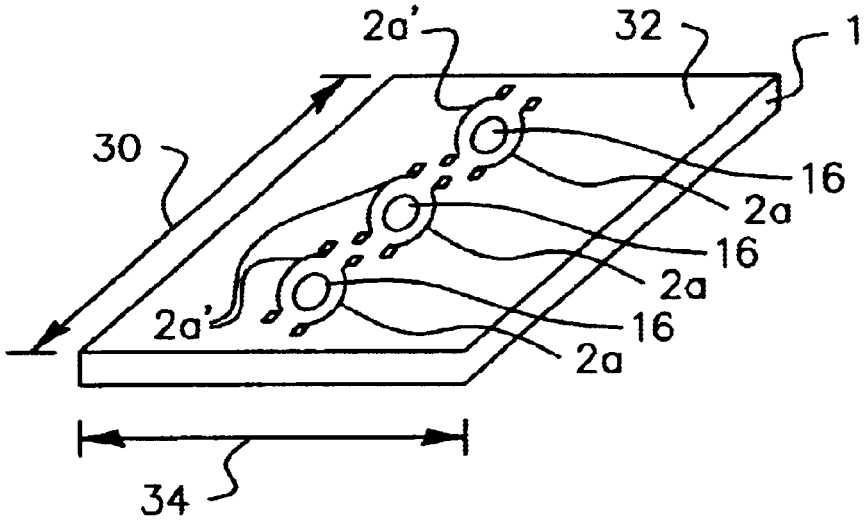
FIG. 4 is a perspective top view of a continuous ink jet print head incorporating the present invention.

Referring to FIG. 4, printhead 1 has a plurality of nozzle bores 16 positioned along a length dimension 30 of printhead 1. A nozzle heater 2*a*/2*a*' is positioned about each nozzle bore 6 on a top surface 32 of printhead 1. Alternatively, nozzle heater 2*a*/2*a*' can be imbedded within the top surface 32 of printhead 1. Printhead 1 also includes a width dimension 34.

Figure 5:
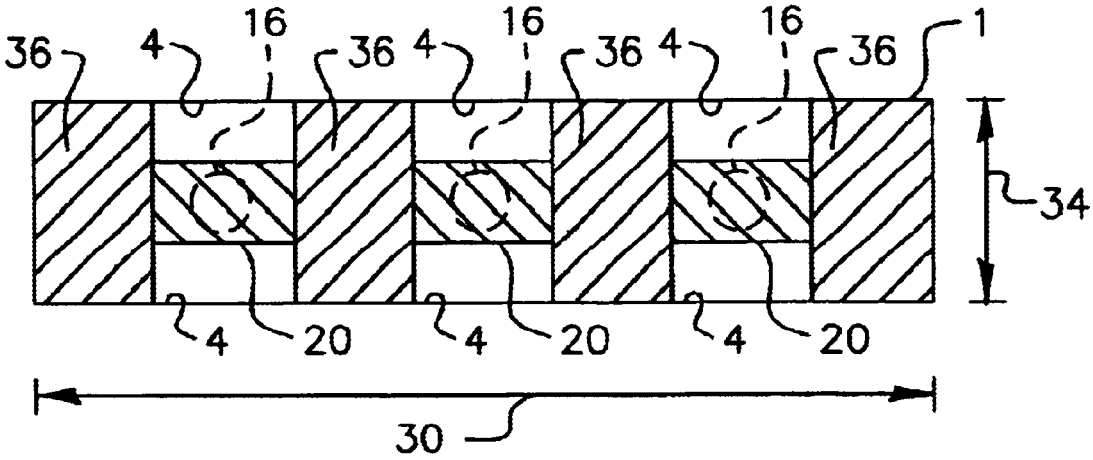
FIG. 5 is a cross sectional bottom view of the printhead shown in FIG. 4 incorporating the present invention.

Referring to FIG. 5, printhead 1 includes an ink delivery channel 4 which supplies ink from ink source 26 through nozzle bores 6. An individual geometric obstruction 20 is positioned in ink delivery channel 4 below each nozzle bore 6. Each geometric obstruction 20 is supported by walls 36. Typically, this is accomplished by integrally forming each obstruction 20 with walls 36 during the printhead fabrication process.

Figure 6A:
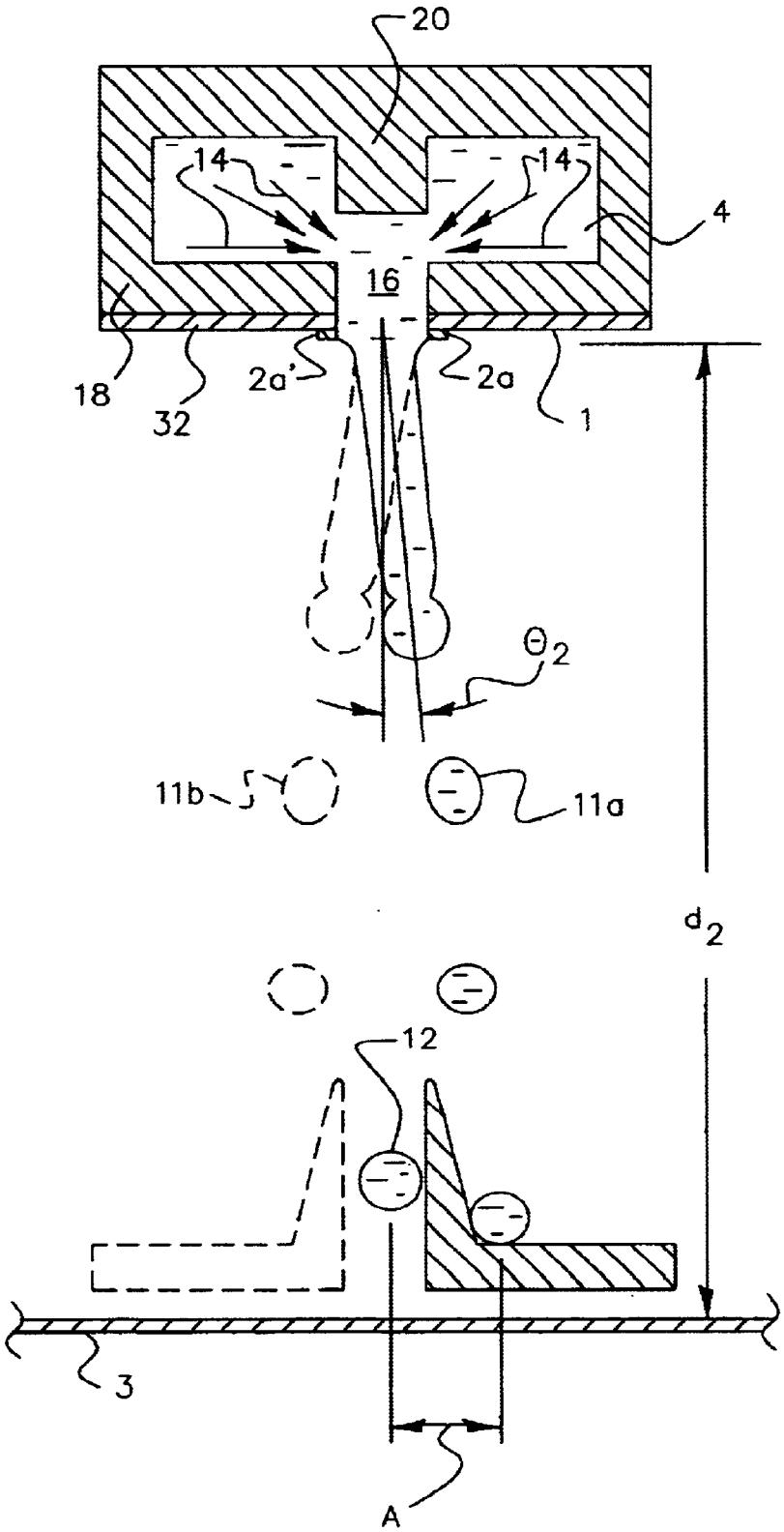
FIG. 6A is a cross-sectional view of one nozzle incorporating one embodiment of the present invention showing $d_2$ and $\theta_2$.
Figure 6B:
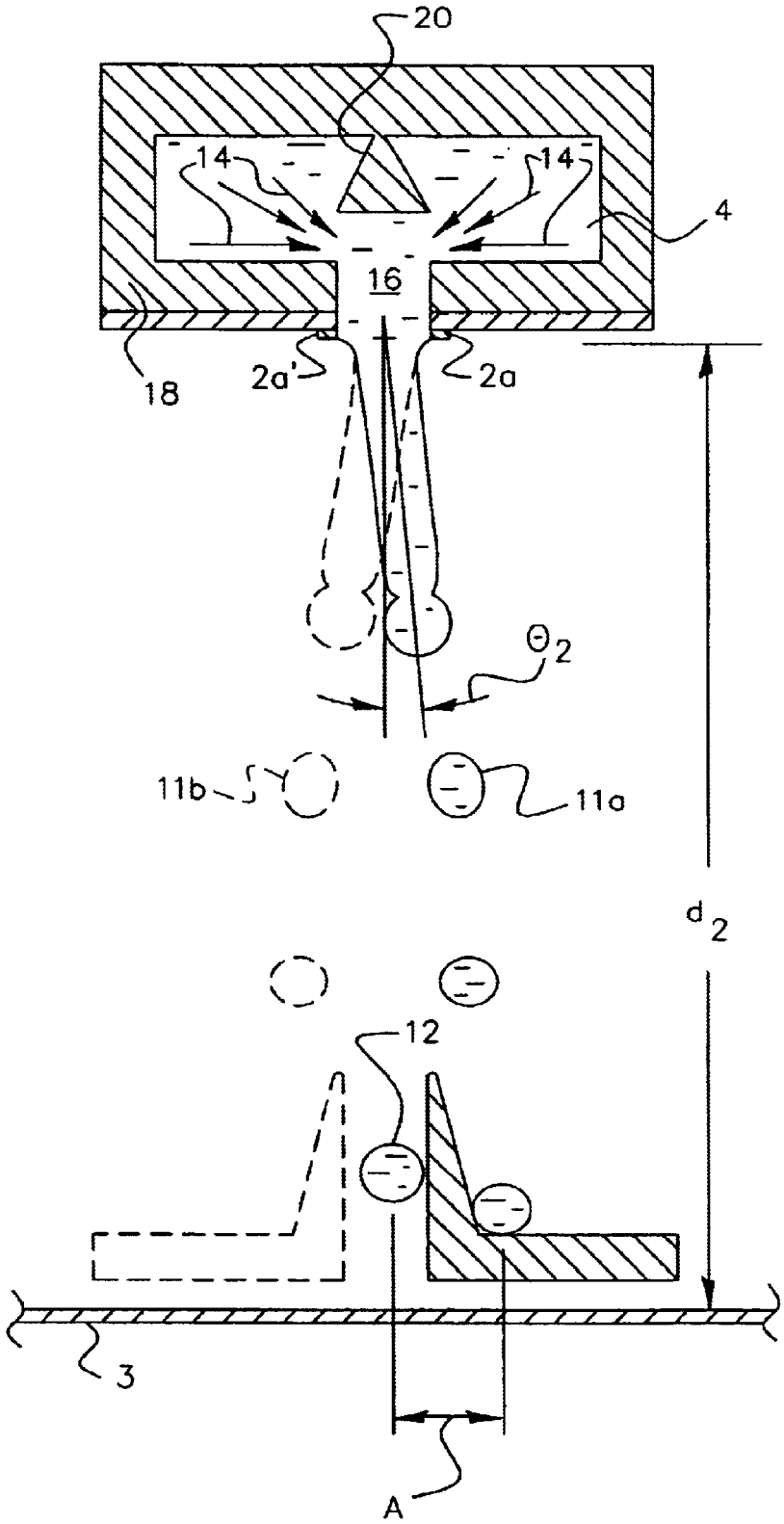
FIG. 6B is a cross-sectional view of one nozzle incorporating another embodiment of the present invention.

Referring to FIGS. 6A and 6B, in the operation of the present invention, the lateral course of ink flow patterns 14 in the ink delivery channel 4, are enhanced by, a geometric obstruction 20, placed in the delivery channel 4, just below the nozzle bore 16. This lateral flow enhancing obstruction 20 can be varied in size, shape and position, and serves to improve the deflection, based upon the lateralness of the flow and can therefore reduce the dependence upon ink properties (i.e. surface tension, density, viscosity, thermal conductivity, specific heat, etc.), nozzle geometry, and nozzle thermal properties while providing greater degree of control and improved image quality. Preferably the obstruction 20 has a lateral wall parallel to the reservoir side of wall 18, such as squares, rectangles, triangles (shown in FIG. 6B with like features being represented using like reference symbols), etc. The deflection enhancement may be seen by comparing for example the margins of difference between $\theta_1$ of FIG. 2 and $\theta_2$ of FIGS. 6*a* and 6*b*. This increased stream deflection enables improvements in drop placement (and thus image quality) by allowing the recording medium 3 to be placed closer to the print head 1 ($d_2$ is less than $d_1$) while preserving the other system level tolerances (i.e. spacing, alignment etc.) for example see distance A. The orifice membrane or wall 18 can also be thinner. We have found that a thinner wall provides additional enhancement in deflection which, in turn, serves to lessen the amount of heat needed per degree of the angle of deflection $\theta_2$.

Figure 7:
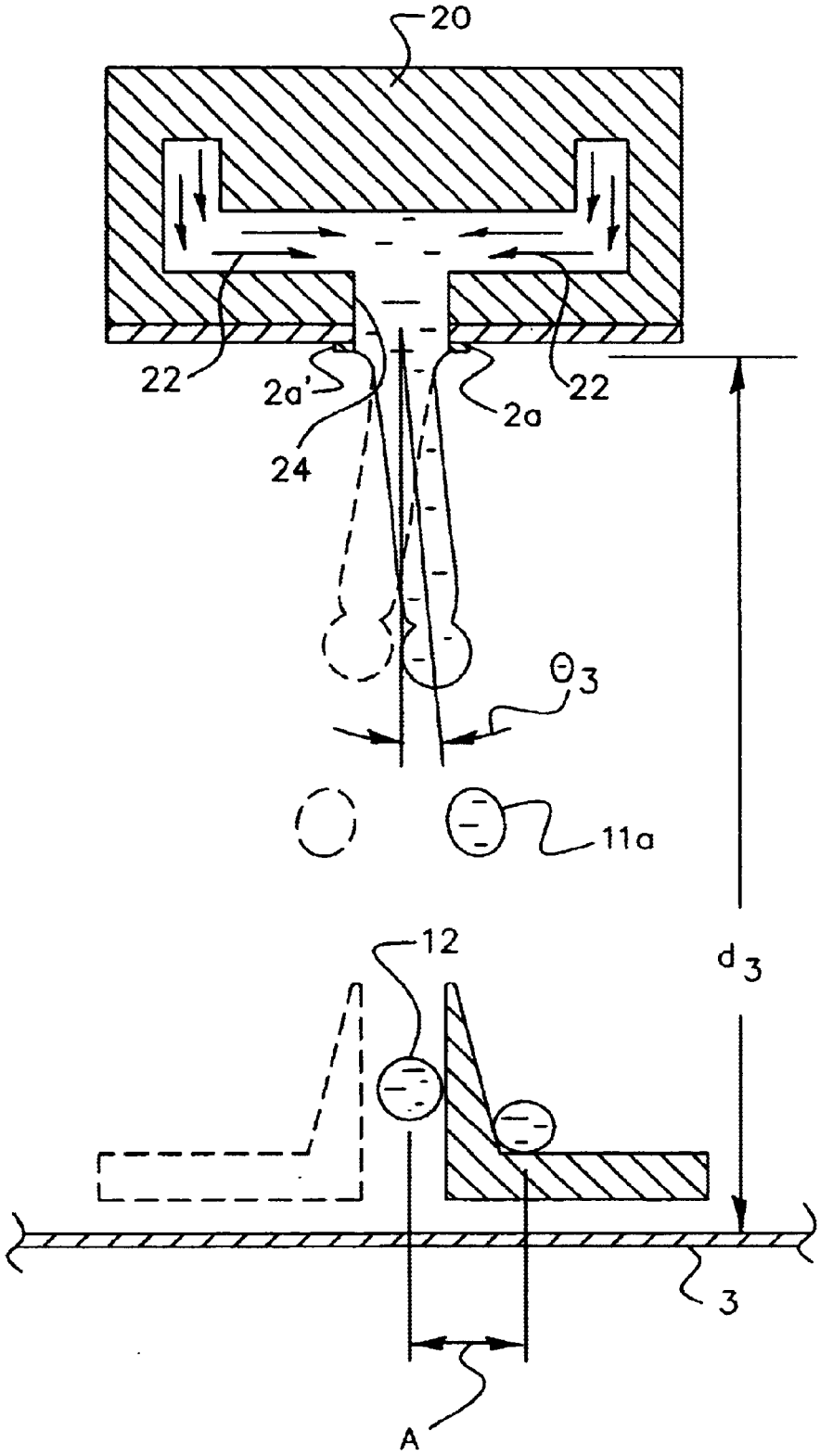
FIG. 7 is a cross-sectional view of one nozzle incorporating a preferred embodiment of the present invention showing $d_3$ and $\theta_3$.

Referring now to FIG. 7 drop placement and thus image quality can be even further enhanced by an obstruction 20 which provides almost total lateral flow 22 at the entrance to nozzle bore 24. The distance $d_3$ to print medium 3 is again lessened per degree of heat because deflection angle $\theta_3$ can be increased per unit temperature.

Figure 8:
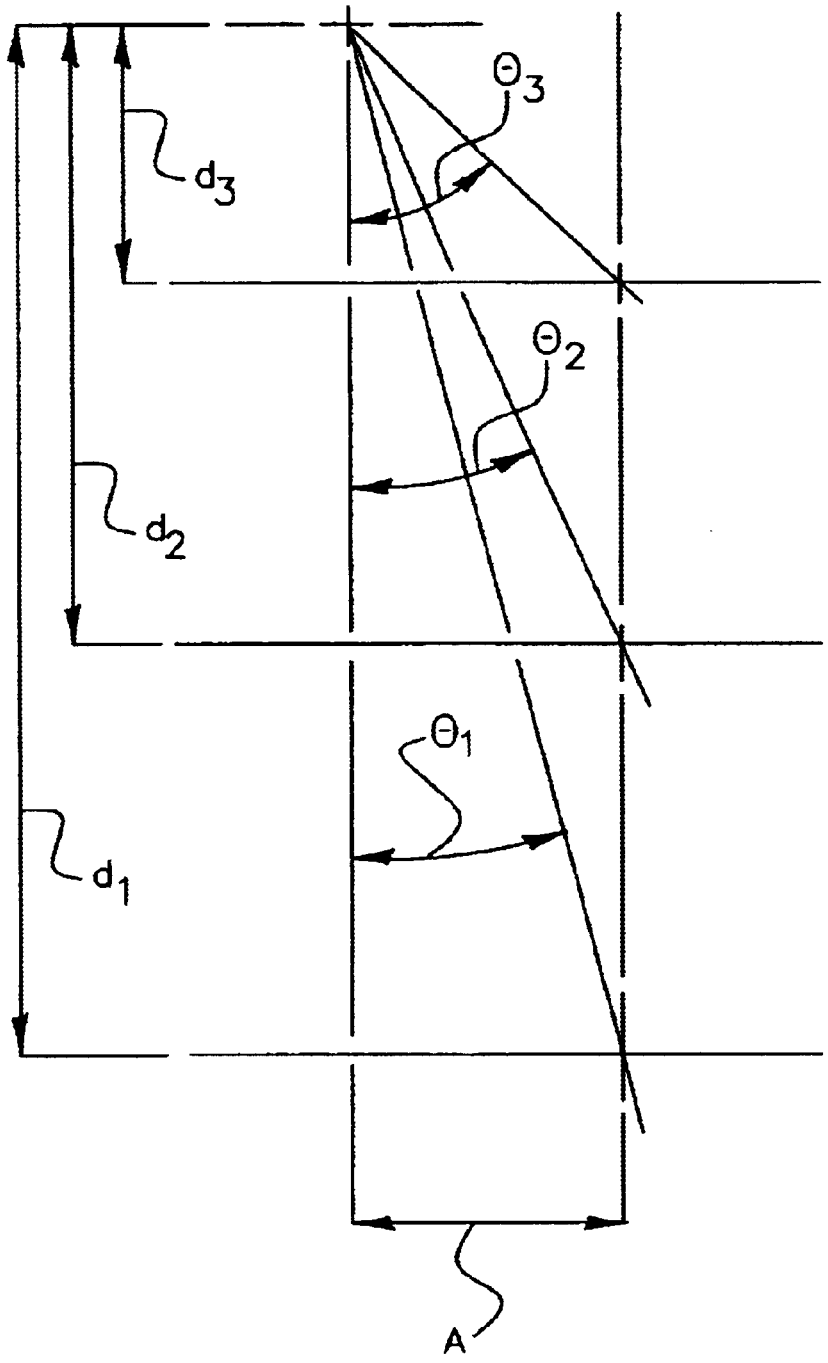
FIG. 8 is a graph illustrating the relationships between $d_1$–$d_3$, $\theta_1$–$\theta_3$, and A.

FIG. 8 shows the relationship of a constant drop placement A as distances to the print media $d_1$, $d_2$, and $d_3$ become less and less and as deflection angles $\theta_1$, $\theta_2$, and $\theta_3$ become increasingly larger. As a consequence of enhanced lateral flow, the ability to miniaturize the printer's structural dimensions while enhancing image size and enhancing image detail is achieved.

What is claimed is:

1. A continuous ink jet printhead comprising:

an ink delivery channel;

a plurality of nozzle bores being in fluid communication with the ink delivery channel; and an individual obstruction associated with each nozzle bore, each individual obstruction having an imperforate surface and being positioned in the ink delivery channel, wherein each obstruction creates a lateral flow pattern in ink continuously flowing through each of the plurality of nozzle bores as measured from a plane perpendicular to the plurality of nozzle bores.

2. The printhead according to claim 1, further comprising:

an ink drop forming mechanism operatively associated with the nozzle bore.

3. The printhead according to claim 2, wherein the ink drop forming mechanism includes a heater having a selectively actuated section associated with a portion of each of the plurality of nozzle bores.

4. The printhead according to claim 1, wherein a portion of each individual obstruction is positioned over the associated nozzle bore.

5. The printhead according to claim 4, the plurality of nozzle bores being positioned in a wall membrane, each obstruction having a lateral wall, wherein the lateral wall of each obstruction is positioned in the ink delivery channel parallel to the wall membrane.

6. The printhead according to claim 4, each of the plurality of nozzle bores array having a diameter, each obstruction having vertical walls, wherein the vertical walls of each obstruction are positioned in the ink delivery channel at locations extending beyond the diameter of each of the plurality of nozzle bores.

7. The printhead according to claim 4, each of the plurality of nozzle bores having a diameter, each obstruction having vertical walls, wherein the vertical walls of each obstruction are positioned in the ink delivery channel at locations substantially equivalent to the diameter of each of the plurality of nozzle bores.

8. The printhead according to claim 1, wherein the individual obstruction is centered over the nozzle bore.

9. A continuous ink jet printhead comprising:

a body, portions of the body defining an ink delivery channel, other portions of the body defining a nozzle bore, the nozzle bore being in fluid communication with the ink delivery channel; and an obstruction having an imperforate surface positioned in the ink delivery channel, wherein the obstruction creates a lateral flow pattern in ink continuously flowing through the nozzle bore as measured from a plane perpendicular to the nozzle bore.

10. The printhead according to claim 9, wherein the other portions of the body define a plurality of nozzle bores, each nozzle bore having an individual obstruction associated therewith.

11. The printhead according to claim 9, wherein a portion of the ink delivery channel is individually associated with each nozzle bore.

12. The printhead according to claim 9, further comprising:

an ink drop forming mechanism operatively associated with the nozzle bore.

13. The printhead according to claim 12, wherein the ink drop forming mechanism is positioned on the printhead at a location other than the obstruction.

14. The printhead according to claim 12, wherein the ink drop forming mechanism is a heater.

15. The printhead according to claim 14, wherein the heater includes a selectively actuated section associated with a portion of the nozzle bore, wherein selectively actuating the section of the heater deflects fluid ejected from the nozzle bore at a predetermined angle as measured from a plane perpendicular to the nozzle bore.

16. The printhead according to claim 9, wherein the continuous flow of ink is supplied by an ink supply in fluid communication with the delivery channel, the ink supply containing ink under pressure sufficient to cause the ink to flow through the nozzle bore.

17. The printhead according to claim 16, wherein the ink supply is remotely positioned relative to the printhead.

18. The printhead according to claim 9, wherein a portion of the obstruction is positioned over the nozzle bore.

19. The printhead according to claim 9, the obstruction having a lateral wall, wherein the lateral wall of the obstruction is positioned in the ink delivery channel parallel to the other portions of the body that define the nozzle bore.

20. The printhead according to claim 9, the nozzle bore having a diameter, the obstruction having a vertical wall, wherein the vertical wall of the obstruction is positioned in the ink delivery channel at a location extending beyond the diameter of the nozzle bore.

21. The printhead according to claim 9, wherein the obstruction is centered over the nozzle bore.

22. The printhead according to claim 9, the nozzle bore having a diameter, the obstruction having a vertical wall, wherein the vertical wall of the obstruction is positioned in the ink delivery channel at a location substantially equivalent to the diameter of the nozzle bore.

23. A method of enhancing ink deflection in a continuous ink jet printhead comprising:

providing a continuous flow of ink through a nozzle bore;

creating a lateral flow pattern in the ink; and causing the ink to deflect as the ink flows through the nozzle bore, wherein creating the lateral flow in the ink includes causing the ink to flow around an obstruction.

24. The method according to claim 23, wherein causing the ink to deflect includes applying heat to a portion of the ink flowing through the nozzle bore.

25. The method according to claim 23, the nozzle bore having a diameter, the obstruction having a vertical wall, wherein the vertical wall of the obstruction extends beyond the diameter of the nozzle bore as viewed from a plane perpendicular to the nozzle bore.

26. The method according to claim 23, wherein the continuous flow of ink is supplied by an ink supply in fluid communication with the nozzle bore, the ink supply containing ink under pressure sufficient to cause the ink to flow through the nozzle bore.

27. The method according to claim 23, wherein the obstruction has an imperforate surface.

28. The method according to claim 27, wherein the imperforate surface of the obstruction is parallel to the nozzle bore as viewed from a plane perpendicular to the nozzle bore.

29. The method according to claim 23, wherein the obstruction is centered over the nozzle bore.

30. The method according to claim 23, wherein the ink flows around the obstruction prior to flowing through the nozzle bore.

31. The method according to claim 23, wherein an individual obstruction is associated with the nozzle bore.

32. A printhead comprising:

an ink delivery channel;

a nozzle bore in fluid communication with the ink delivery channel; and an obstruction having an imperforate surface positioned in the ink delivery channel.

33. The printhead according to claim 32, wherein the obstruction is centered over the nozzle bore.

34. The printhead according to claim 32, the ink delivery channel having at least one wall, wherein the obstruction is attached to the at least one wall.

35. The printhead according to claim 32, the ink delivery channel having at least one wall, wherein the obstruction is integrally formed with the at least one wall.

36. The printhead according to claim 32, further comprising:

an ink drop forming mechanism operatively associated with the nozzle bore.

37. The printhead according to claim 36, wherein the ink drop forming mechanism is positioned on the printhead at a location other than the obstruction.

38. The printhead according to claim 36, wherein the ink drop forming mechanism is a heater.

39. The printhead according to claim 38, wherein the heater includes a selectively actuated section.

40. The printhead according to claim 32, the obstruction having a lateral wall, wherein the lateral wall of the obstruction is positioned in the ink delivery channel parallel to the nozzle bore as viewed from a plane perpendicular to the nozzle bore.

41. The printhead according to claim 32, the nozzle bore having a diameter, the obstruction having a vertical wall, wherein the vertical wall of the obstruction is positioned in the ink delivery channel at locations extending beyond the diameter of the nozzle bore.

42. The printhead according to claim 32, the nozzle bore having a diameter, the obstruction having a vertical wall, wherein the vertical wall of the obstruction is positioned in the ink delivery channel at a location substantially equivalent to the diameter of the nozzle bore.

* * * * *